US011122876B2

(12) United States Patent
Assi

(10) Patent No.: US 11,122,876 B2
(45) Date of Patent: Sep. 21, 2021

(54) TAMPER-PROOF BAGGAGE

(71) Applicant: Carlo Assi, Milan (IT)

(72) Inventor: Carlo Assi, Milan (IT)

( * ) Notice: Subject to any disclaimer, the term of this patent is extended or adjusted under 35 U.S.C. 154(b) by 441 days.

(21) Appl. No.: 16/081,469

(22) PCT Filed: Jan. 25, 2017

(86) PCT No.: PCT/IB2017/050379

§ 371 (c)(1),
(2) Date: Aug. 31, 2018

(87) PCT Pub. No.: WO2017/158443

PCT Pub. Date: Sep. 21, 2017

(65) Prior Publication Data

US 2020/0046098 A1 Feb. 13, 2020

(30) Foreign Application Priority Data

Mar. 14, 2016 (IT) ..... UA2016A001629

(51) Int. Cl.
*A45C 13/18* (2006.01)
*A45C 13/30* (2006.01)
(Continued)

(52) U.S. Cl.
CPC ..... *A45C 13/103* (2013.01); *A45C 13/1069* (2013.01); *A45C 13/18* (2013.01);
(Continued)

(58) Field of Classification Search
CPC ..... A45C 13/103; A45C 13/00; E05B 67/00
See application file for complete search history.

(56) References Cited

U.S. PATENT DOCUMENTS 3,325,869 A * 6/1967 Younger ..... A44B 19/301 24/387
7,979,964 B2 7/2011 Jans
2018/0368536 A1* 12/2018 Newson ..... A45C 13/005

FOREIGN PATENT DOCUMENTS

WO WO 1995/08280 A1 3/1995
WO WO 2012/112633 A1 8/2012
WO WO 2017/158443 A1 9/2017

OTHER PUBLICATIONS

EPO, "International Search Report for related application No. PCT/IB2017/050379", dated Apr. 21, 2017.
(Continued)

*Primary Examiner* — John K Fristoe, Jr.
*Assistant Examiner* — Justin Caudill
(74) *Attorney, Agent, or Firm* — Mark Malek; Widerman Malek, PL

(57) ABSTRACT

The present invention relates to tamper-proof baggage, comprising one opening, and a locking system for the opening. The opening has opposite edges, and the locking system comprises a movable slider and a padlock with a seat. The movable slider comprises a movable element shaped to be engaged with the opposite edges of the opening. The padlock is arranged in proximity to a limit stop position of the slider which corresponds to a closed condition of the opening and the seat of the padlock has a through hole that passes through the padlock. The movable element of said slider has a metal end adapted to be inserted into the through hole of the padlock, and the baggage further comprises a magnetic element arranged downstream of the padlock.

10 Claims, 2 Drawing Sheets

(51) Int. Cl.
*A45C 15/00* (2006.01)
*A45C 13/10* (2006.01)

(52) U.S. Cl.
CPC ..... *A45C 13/30* (2013.01); *A45C 15/00* (2013.01); *A45C 2013/306* (2013.01)

(56) References Cited

OTHER PUBLICATIONS

EPO, "Written Opinion for related application No. PCT/IB2017/050379", dated Apr. 21, 2017.

* cited by examiner

TAMPER-PROOF BAGGAGE

RELATED APPLICATIONS

This application claims the benefit under 35 U.S.C. § 119(e) of Italian patent application Ser. No. UA2016A001629 filed on Mar. 14, 2016 and titled Tamper-Proof Baggage, and is related to PCT patent application Ser. No. PCT/Ib2017/050379 filed on Jan. 25, 2017, also titled Tamper-Proof Baggage the entire content of which is incorporated herein by reference except to the extent that disclosure therein is inconsistent with the disclosure herein.

FIELD OF THE INVENTION

The present invention relates to the field of equipment for securely carrying personal items, particularly to tamper-proof baggage.

Particularly the invention relates to tamper-proof baggage according to the preamble of claim 1.

BACKGROUND

Baggage of everyday use, such as for example bags, backpacks, schoolbags and travelling bags, for many years has been one of the most widespread devices for carrying books, school material, personal items, business documents and/or valuables.

Such baggage is often made of flexible material such as for example fabric, cloth or leather, and typically it comprises one or more inner compartments to which one can access through closable openings made on external surface thereof, and shoulder straps that allow the user to wear it on the shoulders and leaving hands free, resulting in advantages for its ease of transport.

One of the major drawbacks in using such baggage is that often it is subjected to pickpocketing and theft.

Today there are many solutions intended to overcome such drawbacks; the American patent application US 2015/0041511, for example, discloses a backpack provided with a GPS unit to allow it to be tracked, while the Chinese utility model CN 87206337 U discloses, on the contrary, to provide backpacks made of a material reinforced with metal wires, to allow the fabric to be more cut resistant against attempts made by pickpockets.

However such solutions do not overcome the drawback that, with the backpack in the condition carried on the shoulders, the user is not able to realize if pickpockets are opening the closures of the compartments to illicitly take out their contents.

In order to overcome such drawback, the American patent application US 2007/062996 discloses how to provide backpacks provided with compartments closable by zippers, where the latter follow paths ending on the backpack portion in contact with the back of the user.

Such solution, although preventing compartments from being opened in undesired manner while the backpack is worn, however does not guarantee them to be closed when it is not worn.

Generally in order to avoid zippers from unintentionally opening, several solutions are known, such as for example the one disclosed in the American patent application U.S. Pat. No. 3,325,869 that provides magnetic elements that prevent the slider of the zipper from unintentionally sliding backwards and that prevent garments from unintentionally opening, or the one known from the American patent application US 2010/0243114 that provides a slider with hooking levers in order to maintain the zipper closed. Other known solutions to prevent zippers from unintentionally opening, provide padlocks that lock, in their seat, the pull tabs of the movable element of the slider of the zipper.

However such solutions do not prevent them to be opened by pickpockets in an undesired manner, since these are weak closures, simple to be tampered with and quickly eludible without particular skill and that therefore do not provide a valid deterrent for pickpocketing attempts.

SUMMARY OF THE INVENTION

It is the object of the present invention to overcome prior art drawbacks. Particularly it is the object of the present invention to provide tamper-proof baggage preventing pickpockets from opening it in undesired manner.

It is also the object of the present invention to provide tamper-proof baggage equipped with a solid and efficacious locking system.

These and other objects of the present invention are achieved by a tamper-proof baggage embodying the features of the annexed claims, which are an integral part of the present description.

The idea at the base of the present invention provides to make tamper-proof baggage, comprising an opening to access inside of the baggage, and a system locking the opening. The opening has opposite edges with complementary profiles. The locking system comprises a movable slider, and a padlock provided with a seat. The term padlock is used throughout this disclosure and is intended to include any type of locking mechanism such as, for example, a multiple dial lock, as illustrated in the appended figures. The movable slider is insertable and locking means for releasably retaining the movable slider when inserted in the seat; the movable slider comprises:

- a movable element shaped in such a way as to engage the two edges of the opening and to allow them to be engaged when it is moved in a closing direction and to allow them to be released when it is moved in the direction opposite to the closing direction,
- grasping means, connected to the movable element, to allow a user to move the movable element in the closing direction or in the opposite direction.

The padlock is arranged in proximity to a limit stop position of the slider, which corresponds to a closed condition of the opening, and the seat of the padlock has a through hole that passes through the padlock. The movable element of the slider has a metal end adapted to be inserted into the through hole of the padlock, the baggage further comprises a magnetic element arranged downstream of the padlock, in such a wav as to attract the metal end of the movable element through the through hole of the padlock and to place the movable element in such a position to be engaged by the locking means of the padlock.

Such solution allows tampering risks for baggage to be considerably reduced since the combined use of padlock, movable element of the slider passing therethrough and magnetic element that, in addition to retain the movable element, allows it to be properly positioned such to be locked by the locking means of the padlock, gives the baggage a locking system that is complicated and hard to be eludible, which discourages pickpockets from making tampering attempts.

Such solution allows a further improvement for security of tamper-proof baggage to be obtained since the fact of providing the movable element of the slider to be the element locked by the locking means, gives to the baggage a solid, compact and efficacious locking system having very small access spaces between such elements to make cut or tampering attempts.

In one embodiment of the invention, the magnetic element comprises a housing, intended to house a compression spring connected to a hooking lever, where the hooking lever is released when encountering an engagement head of the metal end of the slider, and it couples with such end.

Such solution allows security of tamper-proof baggage to further improve since, even if the presence of a hooking lever that automatically is released when encountering the metal end for then being coupled therewith is in itself a known mechanism, its use in synergy with the provision of a padlock and a magnetic element is a further improvement of the system locking the baggage that, advantageously gives to the baggage according to the invention a locking system with higher security and utility to prevent it from being tampered with.

Further advantageous features of the present invention will be more clear from the following description and from the annexed claims, which are an integral part of the present invention.

BRIEF DESCRIPTION OF THE DRAWINGS

The invention will be described here below with reference to not limitative examples, provided by way of example and not as a limitation in the annexed drawings. These drawings show different aspects and embodiments of the present invention and, where appropriate, reference numerals showing like structures, components, materials and/or elements in different figures are denoted by like reference numerals.

DETAILED DESCRIPTION OF THE INVENTION

While the invention is susceptible of various modifications and alternative constructions, some non-limitative embodiments, provided by way of example, are described in details herein below.

It should be understood, however, that there is no intention to limit the invention to the specific disclosed embodiments but, on the contrary, the invention intends to cover all the modifications, alternative constructions and equivalents that fall within the scope of the invention as defined in the claims.

Therefore in the following description, the use of "for example", "etc.", "or" denotes non-exclusive alternatives without limitation, unless otherwise noted; the use of "also" means "among which, but not limited to", unless otherwise noted; the use of "includes/comprises" means "includes/comprises, but not limited to", unless otherwise noted.

References to "upper", "lower", "above", "under" and the like, when not otherwise noted, have to be intended with reference to an operating condition that is a mounting condition of the device.

The term "baggage" in the present application means a container intended to hold personal items and/or books to be carried, such as for example backpacks, school bags, bags, travelling bags, suitcases, briefcases, trunks or cases.

Figure 1:
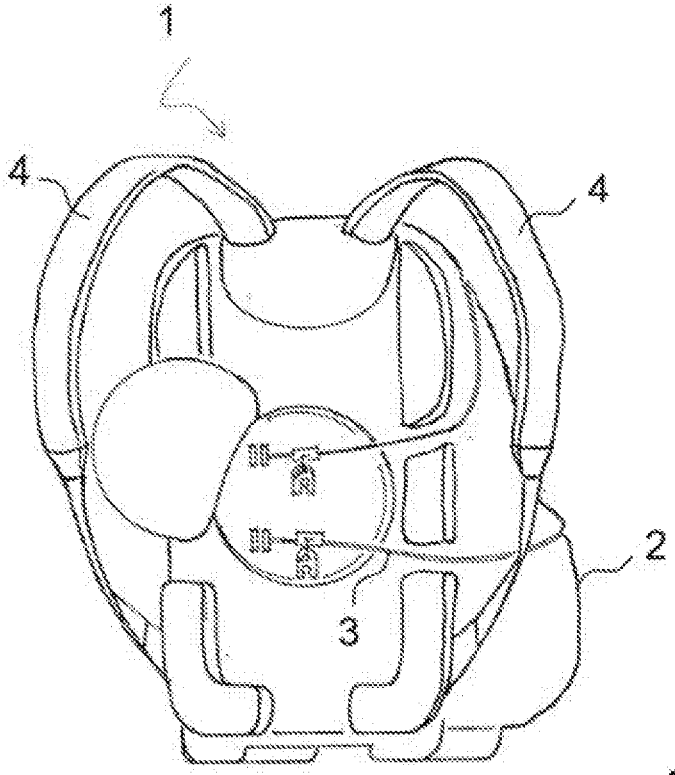
FIG. 1 is a back view of tamper-proof baggage according to the invention.

FIG. 1 shows a back assembly view of tamper-proof baggage 1 according to the present invention.

In the preferred embodiment shown herein, the baggage 1 is a backpack and it comprises a casing 2, made of flexible material, such as for example fabric, synthetic material or leather.

Figure 2:
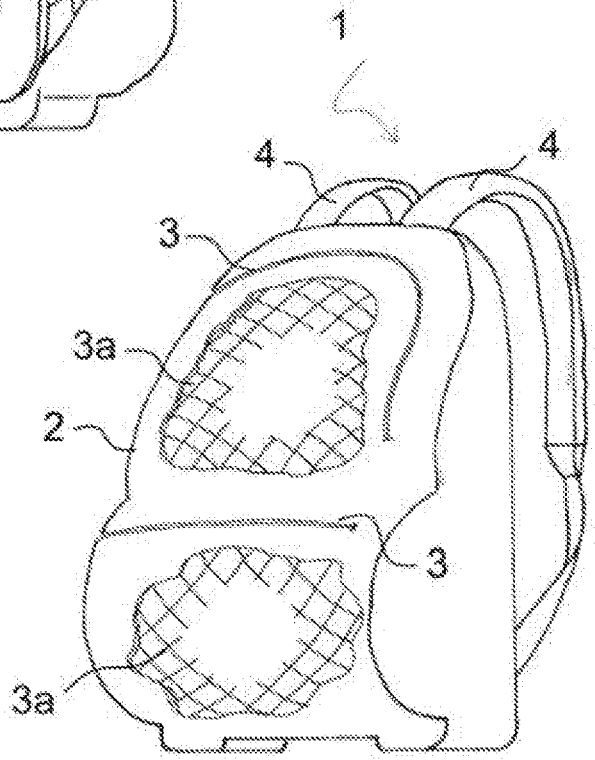
FIG. 2 is an assembly view from a front orientation of tamper-proof baggage of FIG. 1.

Such as seen in FIG. 2, the backpack comprises openings 3 to allow compartments inside the casing 2 to be accessed and in order to insert items or documents to be carried.

To this end the backpack is provided with shoulder straps, belts or the like 4 provided with upper and lower ends, fastened to the casing 2 such that it can be worn on the shoulders and adhere by a portion thereof to a user's back.

In a preferred embodiment, the portion 3*a* of the casing 2 at the openings 3 is made of a material reinforced with light metal wires. Thus, advantageously, the backpack structure has a higher mechanical resistance to undesired cut attempts made by pickpockets.

Figure 3:
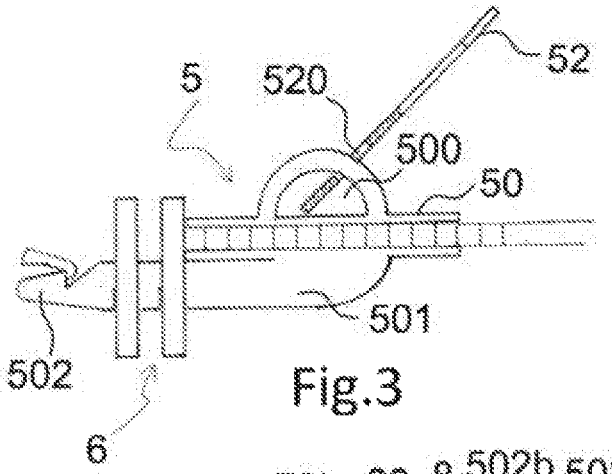
FIG. 3 is a side perspective view of a part of an enlarged detail—locking system—of FIG. 2.

The backpack 1 further comprises a locking system, that in FIG. 3 is shown not provided with a magnetic element mentioned below, which allows its openings 3 to be securely locked. Such system comprises one slider 5 for each opening, free to move along said openings.

More in details, each opening 3 comprises two edges of the casing 2 facing each other and made with complementary profiles, while the slider 5 comprises a movable element 50 shaped such to engage the two edges of the openings.

The movable element 50 allows the two edges to be engaged when it slides in a direction closing the opening 3, and on the contrary it allows them to be released when it is moved in a direction opposite to the closing direction.

For example the complementary profiles of the edges can be composed of a series of hooks applied to one edge, engaging with suitable seats placed on the opposite edge, or as an alternative to such coupling type it is possible to provide two spirals, whose coils have a deformation with a complementary shape, such to remain hooked once penetrating in each other, like a zipper.

The movable element 50, even if not visible in figures, inside it is also provided with a "Y" shaped path, made with such an angle to allow, during its sliding in one or the other direction, the two complementary profiles to be engaged together or opened.

Figure 4:
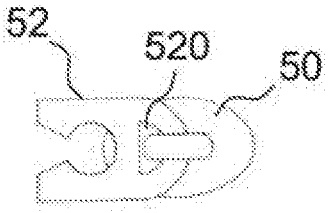
FIG. 4 is a top view of an enlarged detail—grasping means—of a part of the first detail of FIG. 3.

The slider 5 further comprises grasping means 52, shown in detail in FIG. 4, that are connected to the movable element 50 to allow a user to move the latter. In the shown embodiment, the grasping means 52 are a pull tab 52 that provides a eyelet 520, coupled to a slot 500 made on the movable element 50, and shaped such to reproduce a geometry reminding letter "A" and a padlock.

Figure 6:
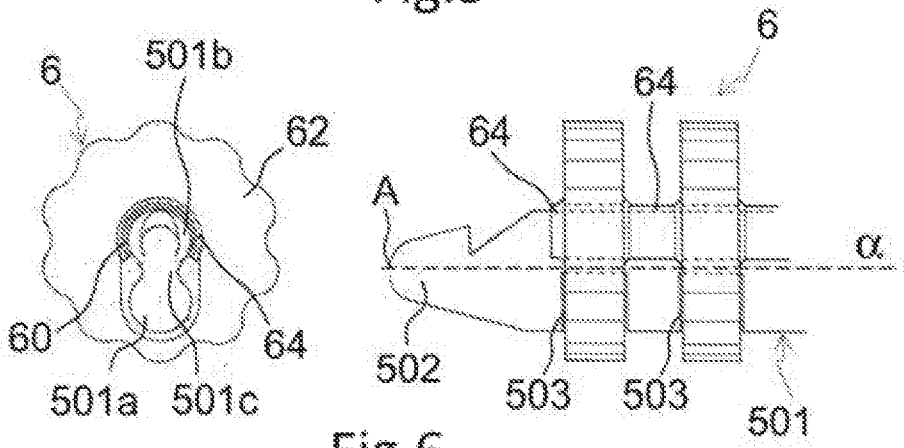
FIG. 6 is a front and side perspective view of two enlarged and operatively connected details—padlock and slider—of the detail shown in FIG. 3.

The locking system further comprises a padlock 6, provided with a seat 60, clearly visible in FIG. 6, wherein the slider 5 is inserted and locking means to releasably retain the slider 5 when it is inserted in such seat 60.

Figure 5:
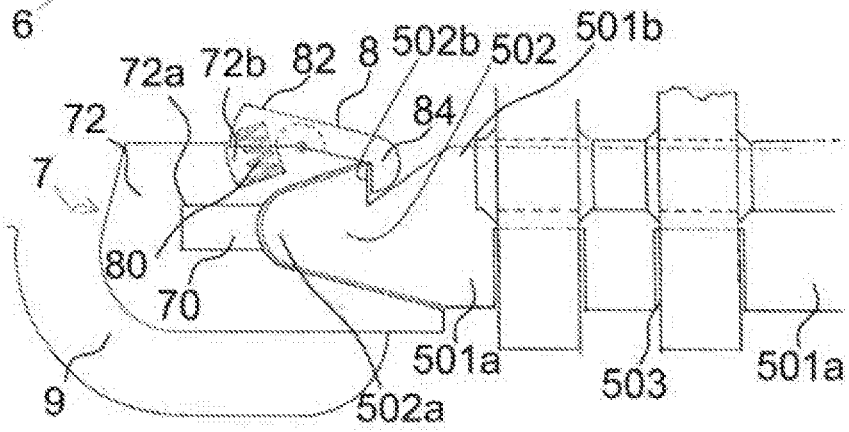
FIG. 5 is a complete, side and enlarged perspective view, of the detail—locking system—of FIG. 2.

Particularly, with reference to FIGS. 3, 5 and 6, the padlock is arranged in proximity to a limit stop position of the slider 5, namely a position corresponding to a closed condition of the opening 3, and its seat 60 has a trough hole passing through the padlock 6.

In detail, when the slider 5 is at the limit stop position, a metal end 501 of the movable element 50 of the slider 5 is inserted into the through hole of the padlock 6.

In the shown embodiment, the metal end 501 is an extension as a single piece of the movable element 50. Such end develops in a direction substantially parallel to the sliding direction of the latter, and in its end portion it is provided with an engagement head 502.

In the shown example, the metal end 501 comprises an upper portion 501*b* and a lower portion 501*a*, both substantially cylindrical, and connected to a connection portion 501*c* made such that a transverse section of the metal end 501 with respect to its development direction, has a substantially "8" shape.

At the engagement head 502, the metal end 501 is tapered to a tip A that is on an axis (α) passing by the connecting portion 501*c* and it is parallel to the development direction of the metal end 501.

Moreover, the metal end 501 is interrupted at intervals by a plurality of recesses 503 obtained on the lower portion 501*a* and extending up to the connecting portion 501*c*. Such recesses are intended to receive locking means 62 of the padlock 6 that, in a preferred embodiment of the invention, is a combination padlock.

Locking means 62 comprise numbered discs, in a number preferably equal to the number of recesses 503—figures show two recesses 503 and two numbered discs 62—obtained on the metal end 501, intended to rotate about the development axis of the upper portion 501*b* of the metal end 501, when the latter is inserted in the padlock 6.

In one embodiment, each of the numbered discs is a gear wheel with internal toothing, wherein such toothing comprises at least one tooth intended to take a respective recess when the wheel is rotated in the condition locking the padlock 6.

Generally, however, each numbered disc comprises a solid portion intended to take a respective recess 503 of the metal end and a through hole—not visible in the figures—where a supporting element 64 is inserted passing through them and to which the discs are coupled.

The supporting element 64 is a hollow cylindrical element whose concave part defines the seat 60 where the upper portion 501*b* of the metal end 501 slides, and whose section has a geometry like a circumference arc ranging an angle higher than 180°. Such arrangement allows the metal end 501 to pass through the discs and it promotes also its proper positioning inside the padlock 6.

In the limit stop position of the slider 5, each recess 503 is at a respective numbered disc 62 that, by rotating in a configuration locking the padlock 6, occupies with a solid portion thereof a respective recess 503 of the metal end 501, therefore preventing the movable element 50 from sliding.

With reference to FIG. 5, the backpack 1 further comprises a magnetic element 7, arranged downstream of the padlock 6, such that when the metal end 501 passes through the through hole of the padlock 6, the magnetic element 7 attracts the metal end 501 and it places the movable element 50 in such a position that it can be engaged by the locking means 62 of the padlock 6.

In the closed position, therefore, the metal end 501 passes through the through hole of the padlock 6, coming out therefrom by at least one portion comprising the engagement head 502 magnetically adhering against the magnetic element 7.

In a preferred embodiment, the magnetic element 7 is further provided with a hooking lever 8 that is released when encountering the engagement head 52 of the metal end 501 of the movable element 50 and it couples with such end.

More in details, the embodiment shown in the figure provides the magnetic element 7 to comprise a magnet 70 enclosed by an enclosure 72 provided with an opening 72*a* to allow the engagement head 502 to contact the magnet 70. On the enclosure 72 of the magnetic element 7 a housing 72*b* is further obtained to house a compression spring 80, that is fastened to a grasping end 82 of the hooking lever 8. Such spring keeps the grasping end 82 of the lever raised, such that when the slider 5 reaches the limit stop position, the engagement head 502 of the metal end 501 encounters the lever 8 at a hooking end 84 and, by urging said end and opposing the retaining force exerted by the spring 80, it raises the hooking end 84, and it couples therewith.

To this end, the engagement head 52 is preferably rounded at portion 502*a* in proximity to its tip, both for facilitating the hooking end 84 of the lever to be raised, and for avoiding tears, friction with the fabric or the surface of the cloth or the wall on the side of the zipper, and any possible interruptions in sliding.

The engagement head 502 further has, on the upper surface, a recess 502*b* made with a geometry conjugated with the geometry of the hooking end 84 and however configured in such a manner that with the lever 8 in the condition hooked to the metal end 501, it prevents the slider 5 from moving in a direction opposite to the direction closing the opening 3.

Advantageously in order to release the lever 8 from the metal end 501, the baggage 1 is further equipped with a leading path 9 surrounding at the lower part the magnetic element 7 for a portion opposite to the portion on which the grasping end 82 of the lever is provided. Such leading path is made such that a user inserting one or more fingers therein, can firmly hold the magnetic element 7 and by the other finger, for example the thumb, can efficaciously press the grasping end 82.

From the functional and structural description above it is clear how the tamper-proof baggage just described allows the proposed objects to be solved and the mentioned advantages to be achieved.

It is clear for a person skilled in the art that it is possible to make changes and variants to the solutions described with reference to figures mentioned above without for this reason departing from the scope of protection of the present patent as defined in annexed claims.

For example such as shown in FIG. 1, it is possible to provide that in the limit stop position the slider 5 is at the baggage portion in contact with the user's back, when he/she carries it on the shoulders.

In a further embodiment, the baggage is equipped with an opening intended to house a telephone device able to receive telephone calls to emit sound of a high volume ringtone, and equipped with GPS technology to be tracked through suitable geo-location applications provided on common mobile phones.

In a further embodiment of the invention, the baggage has a hidden pocket obtained at the baggage portion intended to be in contact with the user's back, comprising the locking system, the magnetic element and the hooking lever, such to hide said elements.

That which is claimed is:

1. Tamper-proof baggage, comprising:

at least one opening to access inside of the baggage; and a locking system for said at least one opening;

wherein said at least one opening has opposite edges with complementary profiles; and wherein the locking system comprises:

a movable slider, and a multiple dial lock comprising a seat, wherein said movable slider is insertable, and locking means comprising a plurality of rotatable numbered discs for releasably retaining the movable slider when inserted in said seat; and wherein said movable slider comprises:

a movable element shaped in such a way as to be engaged with the two edges of said opening and to allow them to be engaged when it is moved in a closing direction and to allow them to be released when it is moved in the direction opposite to the closing direction, and grasping means connected to the movable element to allow a user to move the movable element in said closing direction or in the opposite direction, wherein:

the multiple dial lock is arranged in proximity to a limit stop position of the slider which corresponds to a closed condition of said opening, the seat of said multiple dial lock has a through hole that passes through the padlock, the movable element of said slider has a metal end adapted to be inserted into the through hole of the multiple dial lock;

wherein the baggage further comprises a magnetic element arranged downstream of said multiple dial lock, in such a way as to attract the metal end of said movable element through the through hole of the padlock and to place the movable element in such a position to be engaged by the locking means of the multiple dial lock.

2. The tamper-proof baggage according to claim 1, wherein the magnetic element comprises a magnet, a hooking lever, a housing adapted to house a compression spring connected to the hooking lever, and wherein said hooking lever is released when encountering an engagement head of the metal end of the slider and it couples with such end.

3. The tamper-proof baggage according to claim 1, wherein the metal end is an extension as a single piece of said movable element, and it develops in a direction substantially parallel to the sliding direction of said movable element.

4. The tamper-proof baggage according to claim 3, wherein said metal end comprises an upper portion and a lower portion substantially cylindrical, said upper and lower portion being connected by a connecting portion in such a way that a transverse section of the metal end has a substantially "8" shape.

5. The tamper-proof baggage according to claim 1, wherein said baggage is wearable on a user's back and wherein said opening extends along a path in such a way that in said limit stop position, said slider is at the user's back when the baggage is worn.

6. The tamper-proof baggage according to claim 1, further comprising a GPS tracking device inserted into a compartment of said baggage.

7. The tamper-proof baggage according to claim 1, further comprising a casing made of a reinforced material with light metal mesh.

8. Locking system comprising a movable slider;

a multiple dial lock with a seat, wherein said movable slider is insertable; and locking means comprising a plurality of rotatable numbered discs for releasably retaining the movable slider when inserted in said seat;

wherein said movable slider comprises:

a movable element shaped in such a way as to engage the two edges of said opening and to allow them to be engaged when it is moved in a closing direction and to allow them to be released when it is moved in the direction opposite to the closing direction, and grasping means connected to the movable element to allow a user to move the movable element in said closing direction or in the opposite direction, wherein:

the multiple dial lock is arranged in proximity to a limit stop position of the slider which corresponds to a closed condition of said opening, the seat of said multiple dial lock has a through hole that passes through the padlock, the movable element of said slider has a metal end adapted to be inserted into the through hole of the multiple dial lock, a magnetic element arranged downstream of said multiple dial lock, in such a way as to attract the metal end of said movable element through the through hole of the multiple dial lock and to place the movable element in such a position to be engaged by the locking means of the multiple dial lock.

9. Locking system according to claim 8, wherein the magnetic element comprises a magnet, a hooking lever, a housing adapted to house a compression spring connected to the hooking lever, wherein said hooking lever is released when encountering an engagement head of the metal end of the slider and it couples with such end.

10. Locking system according to claim 8, wherein the metal end of said movable element is an extension as a single piece of said movable element, and it develops in a direction substantially parallel to the sliding direction of said movable element.

* * * * *